US008125349B2

(12) United States Patent
May

(10) Patent No.: US 8,125,349 B2
(45) Date of Patent: Feb. 28, 2012

(54) WARNING SYSTEM FOR PROTECTION FROM WRONG-WAY DRIVERS

(76) Inventor: Rudi May, Würzburg (DE)

( * ) Notice: Subject to any disclaimer, the term of this patent is extended or adjusted under 35 U.S.C. 154(b) by 714 days.

(21) Appl. No.: 11/814,318

(22) PCT Filed: Dec. 7, 2005

(86) PCT No.: PCT/DE2005/002206

§ 371 (c)(1),
(2), (4) Date: May 6, 2008

(87) PCT Pub. No.: WO2006/081785

PCT Pub. Date: Aug. 10, 2006

(65) Prior Publication Data

US 2009/0102683 A1 Apr. 23, 2009

(30) Foreign Application Priority Data

Feb. 4, 2005 (DE) ..... 20 2005 001 927 U

(51) Int. Cl.
*G08G 1/095* (2006.01)

(52) U.S. Cl. ..... 340/907; 340/905; 340/935; 340/933

(58) Field of Classification Search ..... 340/905, 340/935, 933, 941, 907; 701/117
See application file for complete search history.

(56) References Cited

U.S. PATENT DOCUMENTS

| | | | | |
|---|---|---|---|---|
| 5,663,719 | A * | 9/1997 | Deese et al. | 340/912 |
| 6,084,533 | A * | 7/2000 | Morgan et al. | 340/935 |
| 2002/0126022 | A1 * | 9/2002 | Ellis | 340/901 |
| 2004/0008127 | A1 * | 1/2004 | Manavi et al. | 340/907 |
| 2005/0156757 | A1 * | 7/2005 | Garner | 340/907 |

FOREIGN PATENT DOCUMENTS

| | | | |
|---|---|---|---|
| DE | 30 45 038 | A1 | 7/1982 |
| DE | 94 14 007.3 | U1 | 2/1995 |
| DE | 296 01 638 | U1 | 6/1996 |
| DE | 100 60 799 | A1 | 7/2002 |
| EP | 1 339 033 | A1 | 8/2003 |
| JP | 2002-541536 | A | 12/2002 |
| JP | 2004-178055 | A | 6/2004 |
| NL | 1006972 | | 5/1999 |
| WO | WO 00/46775 | A1 | 8/2000 |

OTHER PUBLICATIONS

International Preliminary Report on Patentability with Written Opinion, issued on Aug. 14, 2007 for International Application No. PCT/DE2005/002206, International Filing Date, Jul. 12, 2005, pp. 8 total.
Japanese Office Action for corresponding Japanese Patent Application No. 2007-553447, 3 pages, (Aug. 30, 2011).
PCT International Search Report for PCT Counterpart Application No. PCT/DE2005/002206 containing Communication relating to the Results of the International Search Report, 6 pages, (Mar. 9, 2006).

* cited by examiner

*Primary Examiner* — Daryl Pope
(74) *Attorney, Agent, or Firm* — Blakely, Sokoloff, Taylor & Zafman LLP

(57) ABSTRACT

The invention relates to a warning system (04) for protection from wrong-way drivers (11), in particular on freeways and expressways, wherein a warning and/or alarming of a vehicle traveling contrary to the prescribed travel direction is performed using a warning signal, and wherein the warning signal is an optical and/or acoustic warning signal (09, 10).

1 Claim, 1 Drawing Sheet

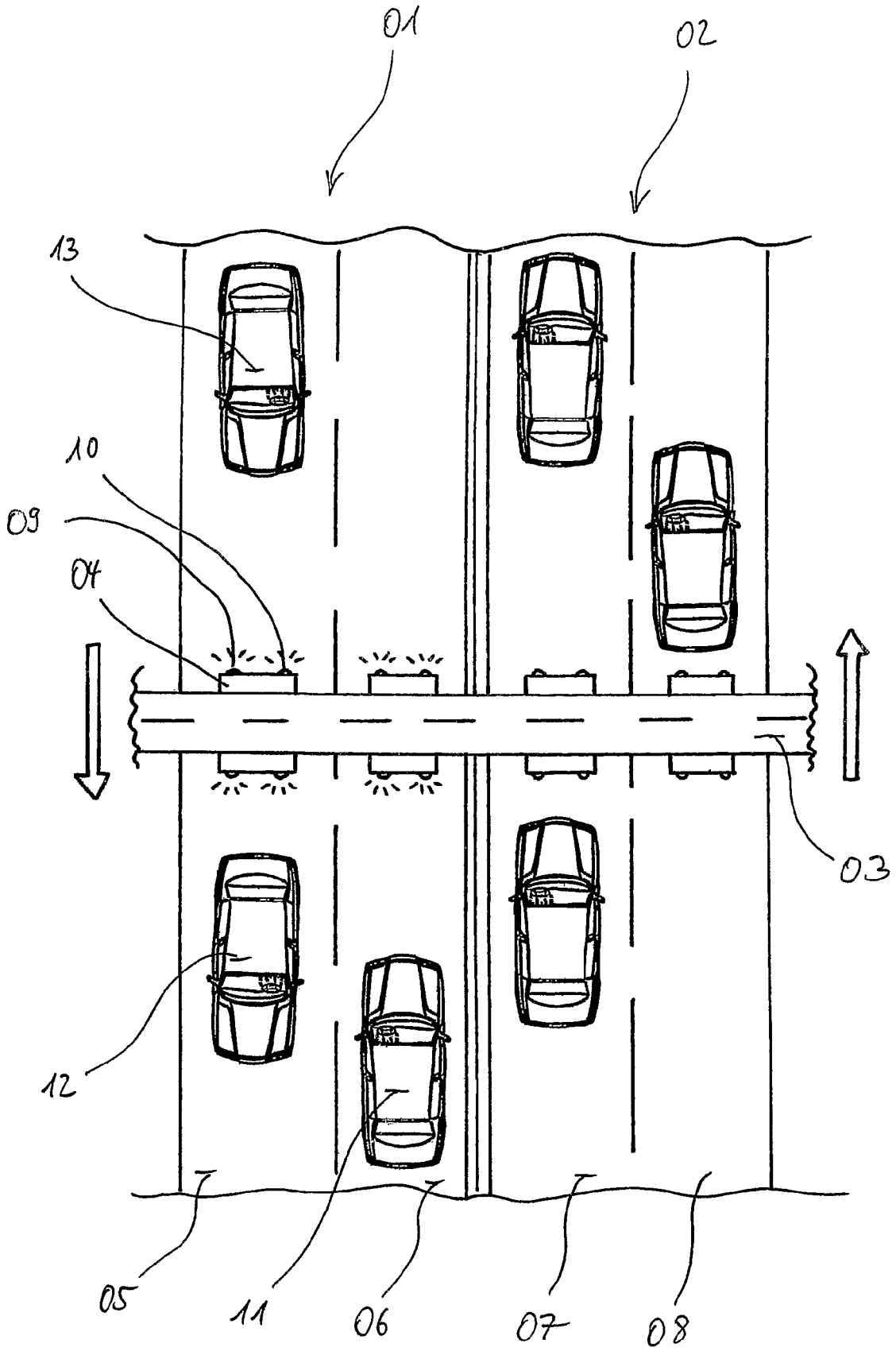
01
02
13
10
09
04
03
12
05
11
06
07
08

WARNING SYSTEM FOR PROTECTION FROM WRONG-WAY DRIVERS

CROSS-REFERENCE TO OTHER APPLICATIONS

This is a National Phase of International Application No. PCT/DE2005/002206 filed on Dec. 7, 2005, which claims priority from German Patent Application No. 20 2005 001 927.5 filed on Feb. 4, 2005.

BACKGROUND OF THE INVENTION

The invention relates to a warning system for protection from wrong-way drivers, in particular on freeways and expressways, wherein a warning and/or alarm of a vehicle traveling contrary to the prescribed travel direction is to be performed using a warning signal.

In preceding years, the number of wrong-way drivers, who endanger not only their own lives, but also the lives of other people, on freeways and expressways has strongly increased, also because of ever-increasing traffic.

It is known that display elements are attached to crossings and/or freeway overpasses for the directional indications in road traffic and/or for notifications of merging lanes or speed limits. These display elements are typically situated above the roadway in such a way that they may be perceived rapidly by the approaching vehicle driver even from a large distance.

However, the display elements known from the prior art have the disadvantage that information about speed limits and/or merging lanes may be obtained, but no means are provided which inform of a wrong-way driver possibly located on the freeway.

The present invention is thus based on the object of suggesting a warning system for protection from wrong-way drivers, which ensures secure and effective protection by detection, analysis, and relay of signals.

SUMMARY OF THE INVENTION

This object is achieved by a warning system according to the teaching of claim 1.

Advantageous embodiments of the present invention are the subject matter of the subclaims.

The invention is based on the main idea of providing a warning system for protection from wrong-way drivers, wherein warning and/or alarming of a vehicle traveling contrary to the prescribed travel direction is performed using a warning signal, and wherein the warning signal is an optical and/or acoustic warning signal.

The suggested warning system thus has the advantage of also implementing the possibility of an acoustic warning signal in addition to an optical warning signal. This is particularly of great advantage in the event of poor weather conditions, such as heavy rain or fog, in which a warning notification only executed optically may possibly be overlooked. On the other hand, a warning signal which is only emitted acoustically would have the disadvantage of not being heard in the event of loud internal noises in the passenger vehicle, such as conversations of several people or loud music. Thus, in a special embodiment of the invention, an acoustic warning signal is to be emitted simultaneously in addition to an optical warning signal.

To achieve a simple and effective warning effect, the optical warning signal may be implemented as a warning lamp, in particular a blinking light and/or traffic signal. The use of such an optical warning signal would have the advantage that the warning system may be produced very cost-effectively.

In a further embodiment of the invention, the optical warning signal may be implemented like a signal board, various signal patterns and/or inscriptions being able to be represented on the signal board. The advantage of such a signal board is the fact that very detailed information, such as "warning—wrong-way driver", may be communicated to approaching vehicle drivers.

To ensure that the acoustic warning signal may be perceived by all traffic participants, it is conceivable to execute the acoustic warning signal using a siren and/or horn. The use of such an acoustic warning signal would have the advantage that the vehicle occupants have the possibility of perceiving the acoustic warning signal even in the event of loud music, for example.

In a further advantageous embodiment of the invention, the acoustic warning signal is a speech signal transmitted by a loudspeaker, such as "warning—wrong-way driver". Such an acoustic warning notification would represent very efficient notification of the imminent danger with simple means.

Furthermore, a control unit may be provided on the warning system for controlling the optical and/or acoustic signals. Using this control unit it is possible to store and/or replay various intervals of the optical and/or acoustic warning signals. Furthermore, such a control unit has advantage that the warning system according to the present invention may be adapted to the current traffic situation at any time.

To implement especially cost-effective operation of the warning system, the warning system may be operated electrically and/or via solar cells. It is possible above all by using solar cells to significantly reduce the operating costs of the warning system according to the present invention.

To provide the warning system with an area of use which is as extensive as possible, the warning system is mountable on a support element, such as a bridge, an overpass, a pillar, and/or a freeway sign or the like. This would have the advantage that no additional or further retainers or support elements would have to be provided for the warning system.

In an especially advantageous embodiment of the invention, a sensor for detecting and/or recognizing a wrong-way driver may be provided in and/or on the warning system. Such a sensor would have the advantage that especially rapid and effective warning of a wrong-way driver may be performed. Therefore, a very safe and efficient warning system for protection from wrong-way drivers may be ensured using simple means.

BRIEF DESCRIPTION OF THE DRAWINGS

An embodiment of the invention is illustrated in the drawing and explained for exemplary purposes in the following.

FIG. 1 shows a schematic illustration of the functional principle of the warning system according to the present invention in a top view.

DETAILED DESCRIPTION OF THE INVENTION

FIG. 1 shows a schematic illustration of a freeway section in a top view, the freeway section having two roadways 01 and 02. A support element 03 is situated above the roadways 01 and 02. Warning systems 04 are situated on both sides of the support element 03, a separate warning system 04 being assigned to each lane 05, 06, 07, and 08 in each travel direction.

The warning system 04 has, inter alia, two optical warning signals 09 and 10 in each case, which are attached to the warning system 04 in such a way that they may be recognized easily by the vehicle driver even from a large distance.

If a wrong-way driver is located on the freeway, as shown here by the wrong-way driver 11 on the lane 06, the warning systems 04 are activated in both travel directions for the lanes 05 and 06 and thus signal to the other traffic participants that a wrong-way driver 11 is located on the freeway. The other traffic participants 12 and 13 may thus be warned in a timely manner and may avoid the approaching wrong-way driver 11 on the roadway 05. In addition to the optical warning signals 09 and 10, acoustic warning signals may be used.

The use of such a warning system 04 thus has the advantage that not only are the other traffic participants 12 and 13 warned of the wrong-way driver 11, but rather also the wrong-way driver 11 obtains an optical an acoustic notification that he is located on the wrong roadway.

What is claimed is:

1. A warning system for protection from wrong-way drivers on bidirectional roadways having a plurality of lanes the warning system consisting of:

at least two optical warning signals to be mounted on each side of a bridge, an overpass, a pillar, or an existing freeway sign located above the bidirectional roadways in order to warn the other traffic participants of the wrong-way driver traveling in a vehicle contrary to the prescribed travel direction and in order to give the wrong-way driver an optical notification that the wrong-way driver is located on the wrong roadway, wherein a separate warning system is assigned to each lane of the plurality of lanes in each travel direction of the bidirectional roadways, wherein the optical warning signal is implemented as signal board that is able to present a detailed message warning of a wrong-way driver, and wherein the warning system may be operated electrically or via solar cells;

an acoustic warning signal, wherein the acoustic warning signal includes a siren, horn, or loudspeaker to transmit a warning speech signal;

a control unit to control the optical and acoustic warning signals;

a sensor to detect or recognize a wrong-way driver.

* * * * *